US010034518B2

(12) United States Patent
Beaufort

(10) Patent No.: US 10,034,518 B2
(45) Date of Patent: Jul. 31, 2018

(54) EXTENDABLE HEEL

(71) Applicant: Christina Beaufort, Jersey City, NJ (US)

(72) Inventor: Christina Beaufort, Jersey City, NJ (US)

( * ) Notice: Subject to any disclaimer, the term of this patent is extended or adjusted under 35 U.S.C. 154(b) by 14 days.

(21) Appl. No.: 15/136,251

(22) Filed: Apr. 22, 2016

(65) Prior Publication Data

US 2016/0309833 A1 Oct. 27, 2016

Related U.S. Application Data

(60) Provisional application No. 62/152,091, filed on Apr. 24, 2015.

(51) Int. Cl.

| | |
|---|---|
| ***A43B 21/36*** | (2006.01) |
| ***A43B 3/24*** | (2006.01) |
| ***A43B 21/00*** | (2006.01) |
| ***A43B 21/51*** | (2006.01) |
| ***A43B 7/38*** | (2006.01) |
| ***A43B 21/42*** | (2006.01) |
| ***A43B 21/437*** | (2006.01) |

(52) U.S. Cl.

CPC ..... *A43B 21/51* (2013.01); *A43B 3/24* (2013.01); *A43B 7/38* (2013.01); *A43B 21/42* (2013.01); *A43B 21/437* (2013.01)

(58) Field of Classification Search

CPC .. A43B 3/24; A43B 7/38; A43B 21/30; A43B 21/42; A43B 21/437; A43B 21/50; A43B 21/51

USPC ..... 36/34 R, 36 A, 81, 100, 105

See application file for complete search history.

(56) References Cited

U.S. PATENT DOCUMENTS

| | | | | |
|---|---|---|---|---|
| 2,707,341 A | | 5/1955 | Romano | |
| 2,934,840 A | | 5/1960 | Mistarz | |
| 3,266,177 A | * | 8/1966 | Holden | A43B 21/30 36/36 C |
| 3,805,418 A | | 4/1974 | Matuka et al. | |
| 3,929,139 A | * | 12/1975 | Salzman | A43B 5/12 36/142 |
| 4,416,072 A | * | 11/1983 | Sarkissian | A43B 3/24 36/100 |
| 5,887,360 A | * | 3/1999 | Bucalo | A43B 3/24 36/100 |
| 6,021,586 A | | 2/2000 | Bucalo et al. | |
| 6,578,289 B1 | * | 6/2003 | Bucalo | A43B 21/51 36/100 |

(Continued)

*Primary Examiner* — Jameson Collier

(74) *Attorney, Agent, or Firm* — Global Intellectual Property Agency, LLC; Daniel Enea

(57) ABSTRACT

An extendable heel for adjusting the height of a heel. The extendable heel includes a heel body and one or more heel portions that are moveable between an extend position and a retracted position. In a retracted position, the heel portions are housed within the heel body and in an extended position, the heel portions are positioned below the heel body. A locking mechanism is operably connected to the heel portions and controls the height and position of the heel portions. The locking mechanism can receive a key that allows a user to control the position of the heel portions. In one use, the turning of the key in a first direction causes a cylinder to rotate, which allows the heel portions to freely move into the extended position. The key can be turned in the opposing direction to secure the heel portion in the extended position.

9 Claims, 6 Drawing Sheets

(56) References Cited

U.S. PATENT DOCUMENTS

| | | | | |
|---|---|---|---|---|
| 6,785,987 | B2 * | 9/2004 | Bucalo | A43B 21/51 36/100 |
| 7,059,068 | B2 | 6/2006 | Magallanes et al. | |
| 8,453,351 | B1 | 6/2013 | Hale | |
| 2002/0144436 | A1 * | 10/2002 | Magallanes | A43B 21/42 36/100 |
| 2006/0101670 | A1 * | 5/2006 | Bucalo | A43B 3/24 36/81 |
| 2006/0130372 | A1 * | 6/2006 | Auger | A43C 15/14 36/134 |
| 2010/0071233 | A1 * | 3/2010 | Savill, Jr. | A43B 3/24 36/100 |
| 2012/0055048 | A1 * | 3/2012 | Haupt | A43B 3/24 36/34 R |
| 2015/0075032 | A1 * | 3/2015 | Skrepenski | A43B 1/0018 36/100 |

* cited by examiner

EXTENDABLE HEEL

CROSS REFERENCE TO RELATED APPLICATION

This application claims the benefit of U.S. Provisional Application No. 62/152,091 filed on Apr. 24, 2015. The above identified patent application is herein incorporated by reference in its entirety to provide continuity of disclosure.

BACKGROUND OF THE INVENTION

The present invention relates to an extendable heel. More specifically, the present invention relates to a height adjustable heel which includes a locking mechanism disposed within the heel and a corresponding key that controls the position of the heel.

Shoes for men and women are readily available with heels which take a variety of sizes, shapes, and dimensions. For walking purposes, a relatively short heel is usually preferable. For dress occasions, the heel is preferably high, and for various other occasions it may be of intermediate height. Although high heels are fashionable, walking or performing other tasks often causes discomfort to the wearer, causing removal of the shoe. However, removing one's shoes risks scratches or punctures of a bare foot due to rocks or other sharp objects found on the ground. Some individuals will carry multiple shoes on their person, each having various heel heights should the need to interchange shoes be desired. Other women prefer to wear shoes with relatively low heels at one time of the day, for example, while commuting to work, and then change to shoes with relatively high heels while at work, only to change back to the shoes with low heels after work. This has the often prohibitive downside of requiring the carrying of another such pair of shoes and the process of changing shoes is very time consuming. Additionally, it is inappropriate to remove one's shoes in some venues.

Other individuals may simply choose to wear a more comfortable shoe having a lower heel at all times. However, because of the variations in styling and preference, selecting shoes based on the heel heights limits the amount of available shoes, which is already limited by the need for a variety of styles, materials, and colors. Also, all heel heights are not comfortable for all wearers. For example, some women prefer a shorter heel than a particular style of shoe is usually found having, and other women prefer a higher heel. In light of these general issues, a shoe having an extendable heel to accommodate variation in heel height is desirable.

Some attempts have been made to provide extendable heels having a pump or pin and spring assembly. However, these attempts to provide height adjustable heels fail to provide a mechanism for locking the height position of the heel. Further, these attempts fail to provide a locking mechanism disposed within the heel and a corresponding key that controls the position of the heel. Thus, it is desirable to provide an extendable heel that is tamperproof and individualized.

In light of the devices disclosed in the prior art, it is submitted that the present invention substantially diverges in design elements from the prior art and consequently it is clear that there is a need in the art for an improvement to height adjustable heels. In this regard the instant invention substantially fulfills these needs.

SUMMARY OF THE INVENTION

In view of the foregoing disadvantages inherent in the known types of extendable heels now present in the prior art, the present invention provides an extendable heel wherein the same can be utilized for adjusting the height of the heel as desired.

It is therefore an object of the present invention to provide a new and improved extendable heel that has all of the advantages of the prior art and none of the disadvantages.

The present invention relates to an extendable heel comprising one or more heel portions in a telescoping arrangement, wherein the heel portions are affixed to the sole of a shoe. The heel portions allow for selective height adjustment of the heel.

It is therefore an object of the present invention to provide extendable heels which are height adjustable, thereby avoiding the necessity of carrying additional shoes or spare heels of different sizes in order to alter the height of the heel.

It is therefore an object of the present invention to provide extendable heels having a locking mechanism that is controllable via a key that adjusts and secures the height of the heel as desired.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
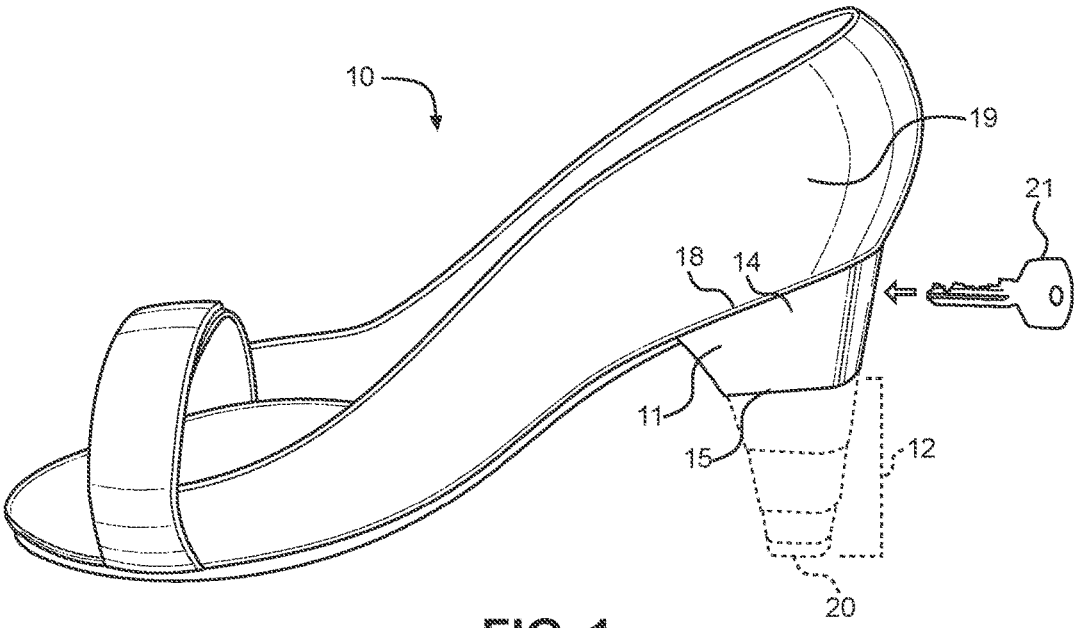
FIG. 1 shows a side view of one embodiment of the present invention in a retracted position.

Reference is made herein to the attached drawings. Like reference numerals are used throughout the drawings to depict like or similar elements of the extendable heels. For the purposes of presenting a brief and clear description of the present invention, the preferred embodiment will be discussed as used for adjusting the height of heels in shoes. The figures are intended for representative purposes only and should not be considered to be limiting in any respect.

Figure 2:
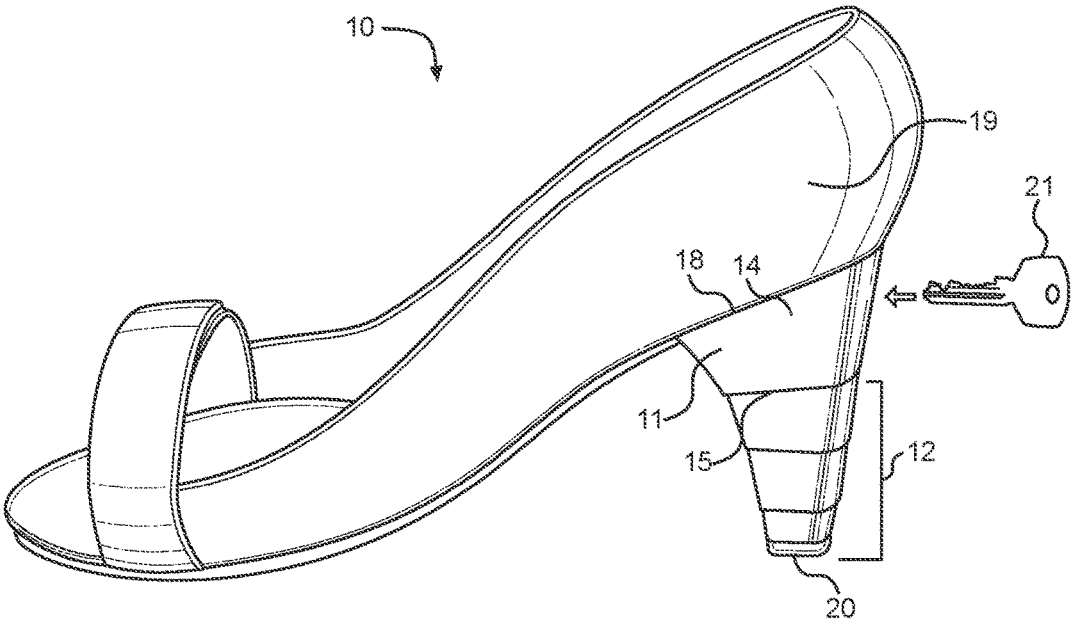
FIG. 2 shows a side view of one embodiment of the present invention in an extended position.

Referring now to FIGS. 1 and 2, there are shown side views of one embodiment of the present invention in a retracted position and an extended position, respectfully. The present invention provides an extendable heel 10 that is selectively height adjustable. The extendable heel 10 comprises a heel body 11 having a plurality of sidewalls defining an interior volume (not shown) configured to receive one or more heel portions 12. The heel body 11 includes a first end 14 and a second end 15, wherein the first end 14 connects a shoe sole 18 thereto and whereby the shoe sole 18 is in connection with and below an upper 19. The one or more heel portions 12 extends outward from the second end 15 and further includes a removable cap 20 configured to engage a planar surface, such as the floor, and provide stability. The cap 20 is sized to correspond to the dimension of one of the heel portions 12, preferably the dimensions of the lower most heel portion 12.

The heel portions 12 are movable between a retracted position and an extended position. When in the retracted position, the heel portions 12 are disposed within the heel body 11. In the extended position, at least one of the heel portions 12 are disposed below the heel body 11. In the shown embodiments, the extendable heel 10 includes three heel portions 12, wherein the exterior of the heel body 11 and the adjacent heel portions 12 form a substantially flush surface. However, in alternative embodiments the extendable heel 10 may have any number of heel portions 12. A locking mechanism 25 and key 21 combination control the height and position of the heel portions 12. For example, in one use, the key 21 is operably connected to the locking mechanism 25, wherein rotation of the key 21 causes the retracted heel portions 12 (FIG. 1) to extend into the extended position (FIG. 2).

Figure 3:
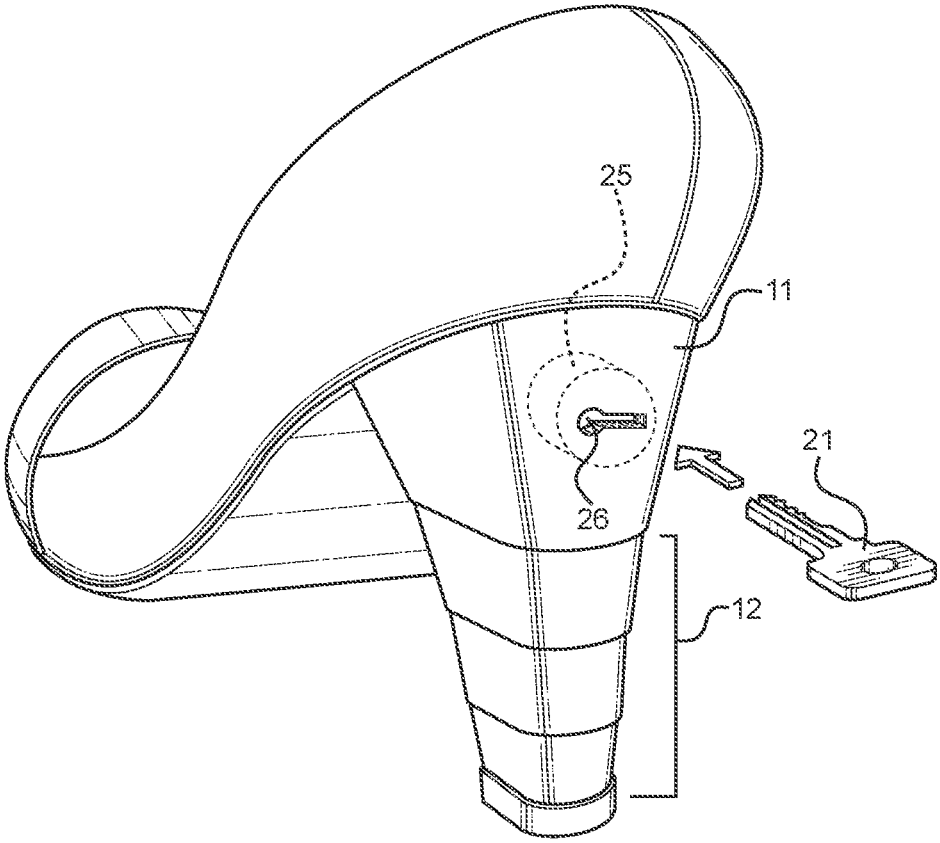
FIG. 3 shows a rear view of one embodiment of the present invention in an extended position.

Referring now to FIG. 3, there is a shown rear view of one embodiment of the present invention in an extended position. The heel body 11 further comprises a locking mechanism 25 operably connected to the heel portions 12, wherein the locking mechanism 25 is configured to permit at least one of the heel portions 12 from moving between the retracted position and extended positioned. In the shown embodiment, the locking mechanism 25 is a pin tumbler lock having an axial keyhole 26 that is adapted to receive a corresponding key 21 for changing the locking state of the locking mechanism 25 between a locked state and an unlocked state. In the shown embodiment, the keyhole 26 of the locking mechanism 25 is disposed on one of the back sidewalls of the heel body 11. However, in alternative embodiments, the keyhole 26 of the locking mechanism 25 may be disposed on any of the plurality of sidewalls of the heel body 11.

Figure 4:
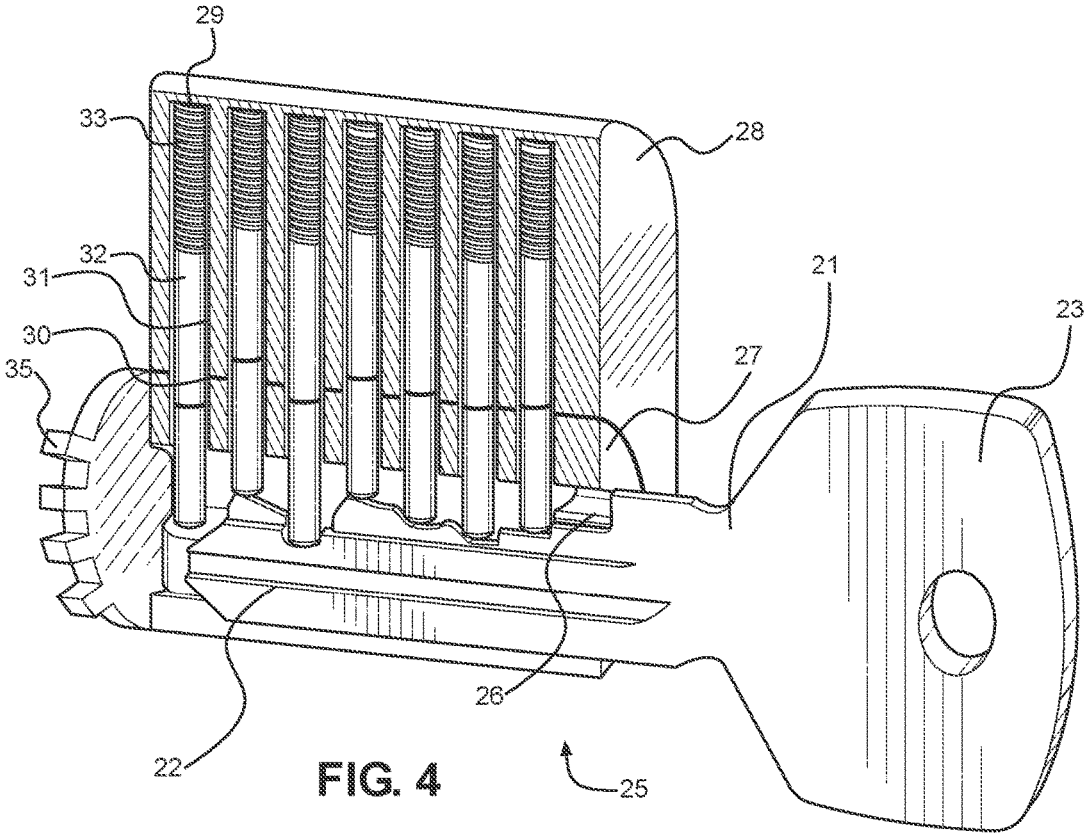
FIG. 4 shows a cross-sectional view of one embodiment of the locking mechanism of the present invention.

Referring now to FIG. 4, there is shown a cross-sectional view of one embodiment of the locking mechanism of the present invention. In the shown embodiment, the locking mechanism 25 is a pin tumbler lock, wherein the pin tumbler lock comprises a rotatable cylinder 27 having a keyhole 26 adapted to receive a key 21. The key 21 comprises a blade 22 configured to slide into the keyhole 26, wherein the blade 22 is configured to be distinguishable between other key blades. Thus, the key 21 is configured for use with the corresponding locking mechanism 25. Once received within the keyhole 26, a bow 23 of the key 21 is configured to protrude from the keyhole 26 so that a user can selectively apply a torque thereto and rotate the key 21.

In the shown embodiment, the rotatable cylinder 27 is coaxial with a fixed housing 28, wherein the fixed housing 28 surrounds a portion of the rotatable cylinder 27. The rotatable cylinder 27 comprises a plurality of circumferentially spaced gear teeth 35 configured to engage with a sliding pin (not shown). In one embodiment, the gear teeth 35 extend past the fixed housing 28, wherein rotation of the cylinder 27 is not inhibited by the fixed housing 28. A tumbler channel 29 runs between the fixed housing 28 and rotatable cylinder 27. The tumbler channel 29 is configured to receive a plurality of tumbler pins 30 therein. The tumbler pins 30 comprise a rod having a free first section 31 and a second section 32 disposed in a linear arrangement, wherein the second section 32 is connected to a spring 33. As the tumbler pins 30 are compressed, the spring 33 is also compressed. The first and second tumbler pin sections 31, 32 are separate and distinct from one another. The length of each section 31, 32 corresponds to the key 21, specifically the shape, depth, and cut of the blade 22. Thus, a received key 21 causes the first section 31 to be positioned within the cylinder 27 and the second section 32 to be positioned within the fixed housing 28. When a torque is applied to the bow 23 in a first direction, the cylinder 27 rotates within the fixed housing 28.

Figure 5:
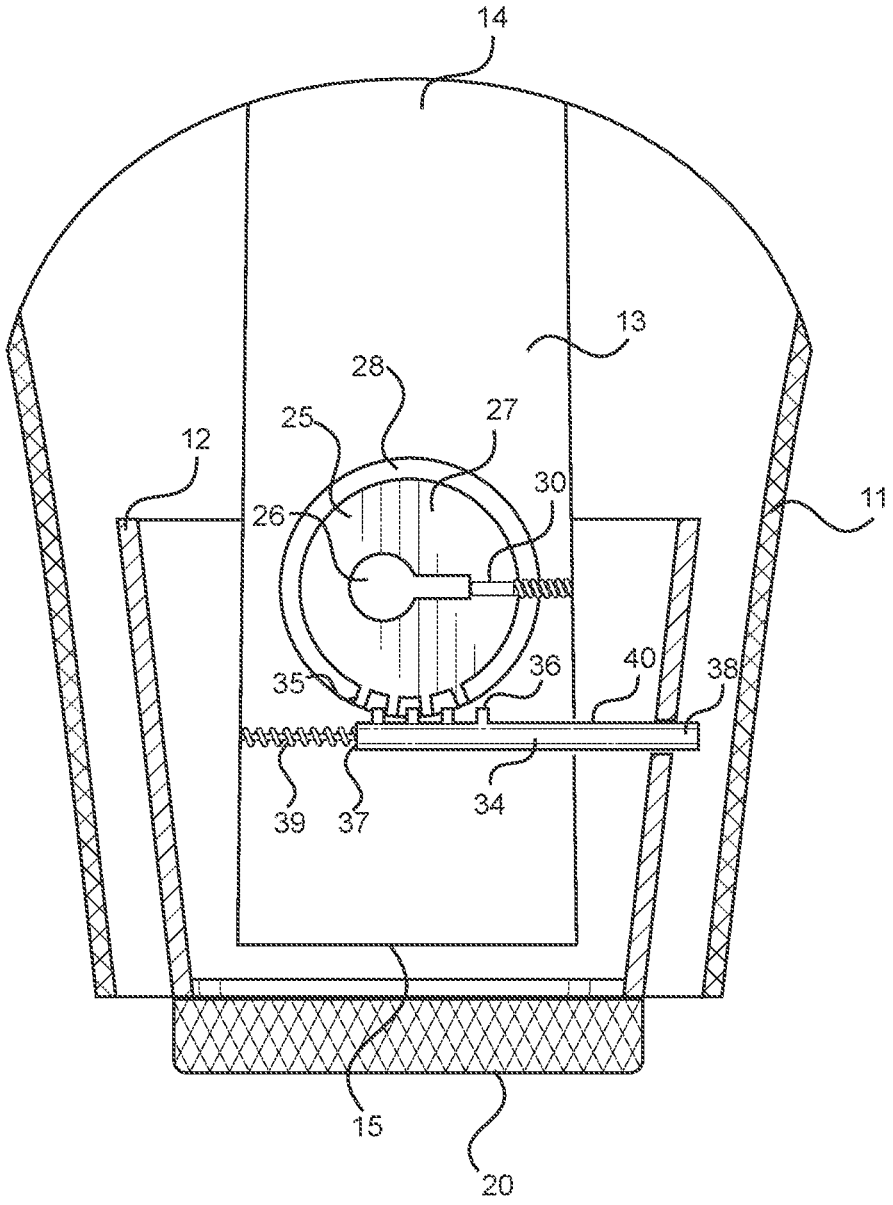
FIG. 5 shows a cross-sectional view of one embodiment of the present invention in a retracted position.
Figure 6:
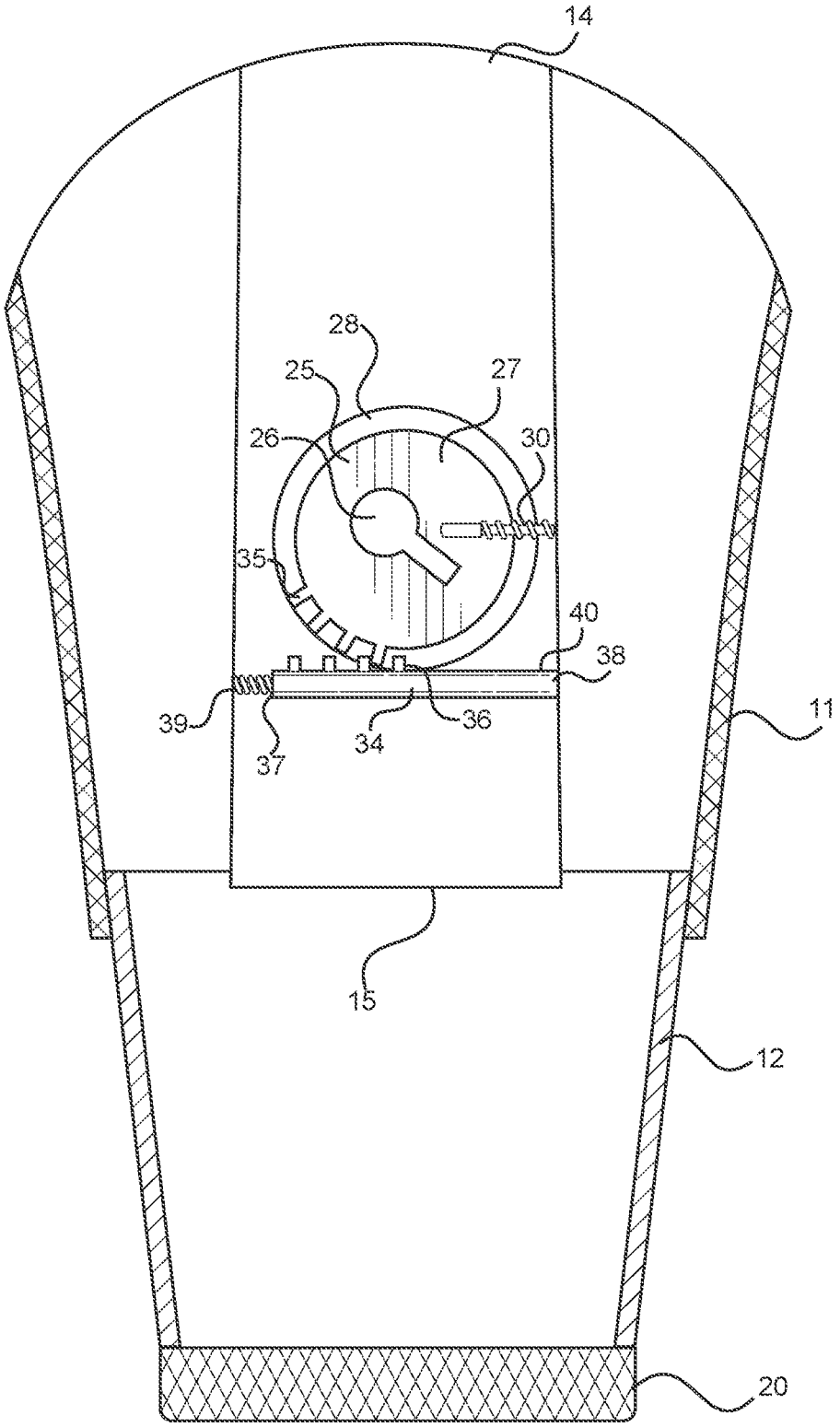
FIG. 6 shows a cross-sectional view of one embodiment of the present invention transitioning between a retracted position and an extended position.
Figure 7:
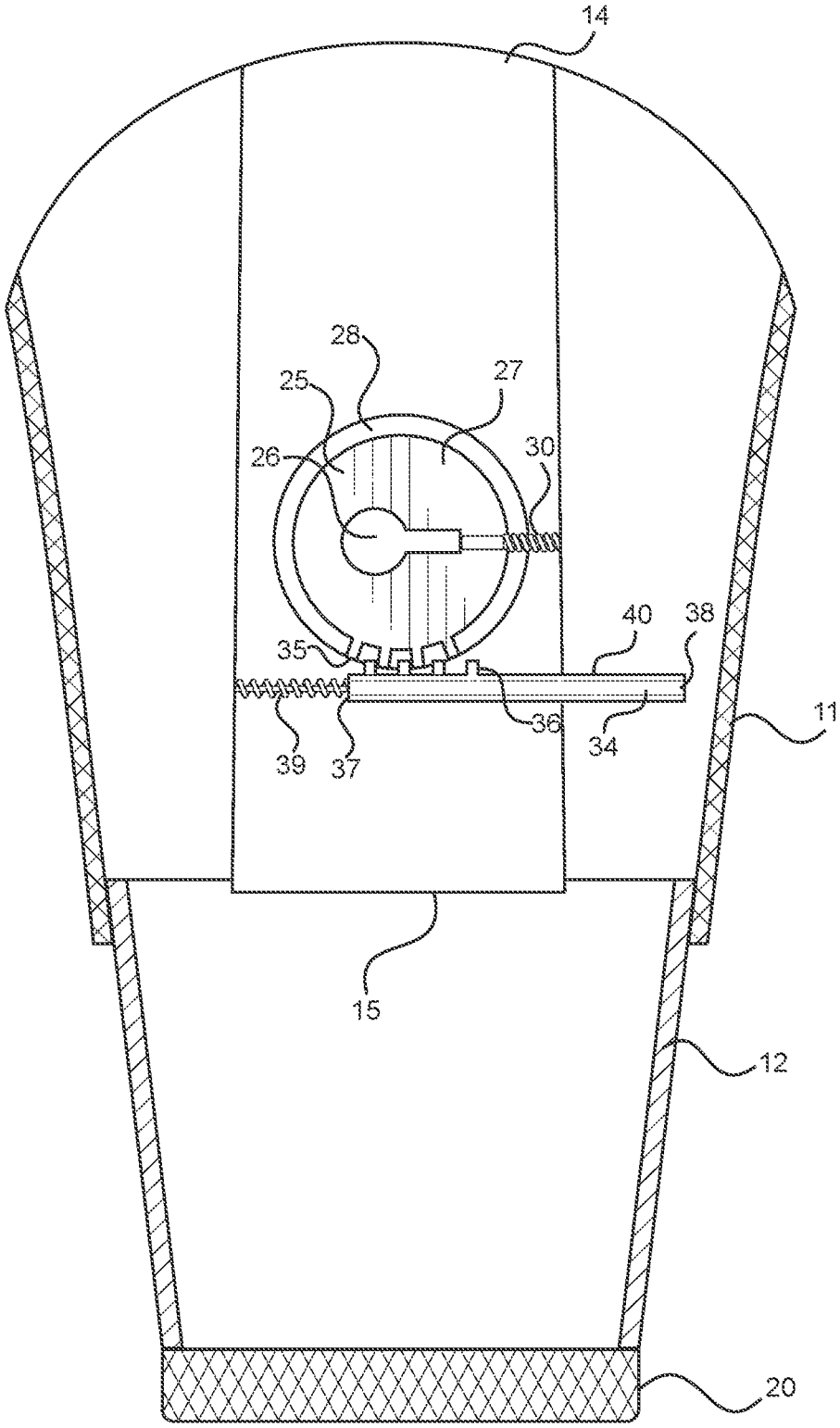
FIG. 7 shows a cross-sectional view of one embodiment of the present invention in an extended position.

Referring now to FIGS. 5-7, there are a shown cross-sectional views of one embodiment of the present invention showing the extendable heel in a retracted position, transitioning between a retracted position and an extended position, and in an extended position, respectfully. In the shown embodiment, the locking mechanism 25 is disposed within the heel body 11 and includes a rotatable cylinder 27 comprising a plurality of circumferentially spaced gear teeth 35 configured to engage with a sliding pin 34. The sliding pin 34 comprises a generally tubular rod having a plurality of spaced protruding members 36 configured to interlock with the gear teeth 35 of the rotatable cylinder 27. The sliding pin 34 includes a first end 37 connected to a spring 39 and an opposing second end 38, wherein the second end 38 is positioned within a channel 40 that runs through the heel body 11 and heel portions 12 when the heel portions 12 are in a retracted position. In the shown embodiment, the heel portions 12 includes one heel portion 12, however in alternative embodiments, there are any number of heel portions 12. In this way, the sliding pin 34 causes the heel portions 12 to remain within the heel body 11.

In use, the keyhole 26 receives the key blade (not shown) that corresponds to a particular locking mechanism 25. Once inserted, the key blade causes the tumbler pin 30 to compress the spring 33 and align the tumbler sections 31, 32 such that one section is positioned within the rotatable cylinder 27 and the other is positioned within the fixed housing 28. The alignment of the tumbler sections 31, 32 allows a torque force selectively applied to rotate the rotatable cylinder 27. The rotation of the cylinder 27 causes the gear teeth 35 to engage with the interlocked protruding members 36 of the sliding pin 34. The sliding of the pin 34 causes the second end 38 to retract from the heel portions 12, wherein the heel portion 12 is free to extend from the heel body 11. In one embodiment, the heel portions 12 are gravity operable, however in alternative embodiments other mechanism, such as springs or pumps, may be utilized for changing the position of the heel portions 12 or the heel portions 12 may be hand manipulated into position.

Once moved into an extended position, the user can selectively return the locking mechanism 25 into the locked state by applying a torque in an opposing second direction. In this way, the heel portion 12 is prevented from moving back into the heel body 11 by the sliding pin 34 that is extended outward. Further, the sliding pin 34 prevents tilting and bending of the heel portion 12 secured in the extended position under the stress of standing, walking, or running.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An extendable heel comprising:

a heel body affixed to a shoe sole;

a first heel portion slidably mounted to the heel body, the first heel portion movable between a retracted position and an extended position;

a locking mechanism disposed within the heel body configured to control the position of the first heel portion from moving between the retracted position and the extended position;

wherein the first heel portion is disposed within the heel body when in the retracted position;

wherein the first heel portion is disposed below the heel body when in the extended position;

the locking mechanism further comprises a pin tumbler lock having a rotatable cylinder, the rotatable cylinder having an axial keyhole configured to receive a key.

2. The extendable heel of claim 1, wherein:

the shoe sole is affixed to a shoe having an upper; wherein the shoe sole is disposed below the upper and connected thereto; and wherein the heel body is arranged below the shoe sole.

3. The extendable heel of claim 1, further comprising:

a key configured to be received by the locking mechanism.

4. The extendable heel of claim 1, wherein:

the rotatable cylinder is disposed within a fixed housing.

5. The extendable heel of claim 1, wherein:

the pin tumbler lock comprises one or more tumbler pins.

6. The extendable heel of claim 5, wherein:

the one or more tumbler pins each respectively comprise a first section and a second section in linear arrangement with one another;

wherein the keyhole is configured to receive a key that can actuate the one or more tumbler pins to cause each first section to be positioned within the rotatable cylinder and each second section to be positioned within the fixed housing to thereby permit rotation of the cylinder with respect to the fixed housing.

7. The extendable heel of claim 1, wherein:

the locking mechanism further comprising a sliding pin, the rotatable cylinder comprises a plurality of circumferentially spaced gear teeth configured to engage with the sliding pin.

8. The extendable heel of claim 7, wherein:

the sliding pin comprises a plurality of spaced protruding members configured to interlock with the gear teeth of the rotatable cylinder.

9. The extendable heel of claim 8, wherein:

the rotatable cylinder is configured to rotate to cause the sliding pin to actuate, to thereby permit the first heel portion to move between the retracted position and the extended position.

* * * * *